United States Patent [19]

Tuller

[11] Patent Number: 4,951,028

[45] Date of Patent: Aug. 21, 1990

[54] POSITIVE TEMPERATURE COEFFICIENT RESISTOR

[75] Inventor: Harry L. Tuller, Wellesley Hills, Mass.

[73] Assignee: Massachusetts Institute of Technology, Cambridge, Mass.

[21] Appl. No.: 318,732

[22] Filed: Mar. 3, 1989

[51] Int. Cl.[5] ..... H01C 7/10

[52] U.S. Cl. ..... 338/22 R; 338/225 D; 338/25; 374/183; 374/185

[58] Field of Search ..... 338/22 R, 225 D, 34, 338/25; 219/548, 549; 374/183, 185, 172, 173, 176, 178

[56] References Cited

U.S. PATENT DOCUMENTS

| | | | |
|---|---|---|---|
| 4,072,848 | 2/1978 | Johnson et al. | 219/549 X |
| 4,117,312 | 9/1978 | Johnson et al. | 219/548 |
| 4,507,643 | 3/1985 | Swano et al. | 338/34 |
| 4,853,538 | 8/1989 | Jackson | 250/336.2 |

OTHER PUBLICATIONS

Relva C. Buchanan, "Ceramic Materials for Electronics", Marcel Dekker, Inc., Chapter 5 (1986).

D. W. Johnson et al., "Fabrication of Ceramic Articles from High Tc Superconducting Oxides", Adv. Ceram. Mat. 2, pp. 364–371 (1987).

W. W. Davison et al., "High Tc Superconducting Films from Metallo-Organic Precursors", Mat. Res. Soc. Symp. Proc. on High-Temperature Superconductors, vol.99, 1988, pp. 289–292.

M. Gurvitch and A. T. Fiory, "A Metal Alloy Process for the Formation of Oxide Superconducting Films", in Mat. Res. Soc. Symp. Proc. on High-Temperature Superconductors, vol. 99, 1988, pp. 297–301.

P. H. Ballentine, Thin Films of Y-Ba-Ca-O by R. F. Sputtering, in Mat. Res. Soc. Symp. Proc. on High-Temperature Superconductors, vol. 99, 1988, pp. 335–338.

T. Wada et al., "Substitution Effect of Sr for Ba of High Tc Superconductivity $YBa_2Cu_3O_{7-x}$ Ceramics", Jpn. J. Appl. Physics, Pt. 2, 26 [5] pp. L706–L708 (1987).

S. Ohshima et al., "Superconducting and Structural Properties of the New $Ba_{1-x}Ln_xCuO_{3-y}$ Compound System", Jpn. J. Appl. Physics, Pt. 2, 26 [5], pp. L815–L817 (1987).

G. S. Grader et al., "Oxygen Stoichiometry in $Ba_2YCu_3O_x$ and $Ba_2GdCu_3O_x$ Superconductors as a Function of Temperature", Adv. Cer. Mat. 2 [3B], pp. 649–655 (1987).

J. M. Tarascon et al., "3-d Metal Doping of the High Temperature Superconducting Perovskites La—Sr—Cu—O and Y—Ba—Cu—O" Phys. Rev. B36 [16] 8393 (1987).

S. Nagata et al., "High $T_c$ Thin Films of $(La_{1-x}M_x)yCuO_{4-\delta}$ (M=Sr, Ba, Ca) Prepared by Sputtering", Jpn. J. Appl. Physic., pt. 2, 26 [4], pp. L410–L412 (1987).

Y. Maeno et al., "Superconductivity in $YBa_2CU_{3-y}Ni_yO_{7-\delta}$", Jpn. J. Appl. Physics, Pt. 2, 26 [5], pp. L774–L776.

*Primary Examiner*—Bruce A. Reynolds
*Assistant Examiner*—Marvin M. Lateef
*Attorney, Agent, or Firm*—Fish & Richardson

[57] ABSTRACT

The resistor includes a cooper oxide ceramic with perovskite related structures exhibiting positive temperature coefficient of resistance characteristics in the temperature range of 300°–900° C. Suitable materials are $YBa_2Cu_3O_{7-x}$, $La_2CuO_4$ and related compounds with other rare earth elements substituted for Y and La and other alkaline earth elements substituted for Ba.

30 Claims, 2 Drawing Sheets

POSITIVE TEMPERATURE COEFFICIENT RESISTOR

The Government has rights in this invention pursuant to Grant Number DMR-84-18896 awarded by the National Science Foundation.

BACKGROUND OF THE INVENTION

This invention relates to positive temperature coefficient ceramic resistors.

Positive temperature coefficient resistors are devices whose resistance increases with increasing temperature. Metals very weakly exhibit this property whereas doped-$BaTiO_3$-based ceramics exhibit a much stronger positive temperature coefficient characteristic. These barium titanate ceramics are used for temperature sensing, switching, current stabilization, and self regulating heating. See, for example, U.S. Pat. No. 4,086,467, which discloses a self-regulating heater utilizing barium titanate. These ceramics are, however, limited to operating temperatures below 300° C. and typically below 250° C. See, "Ceramic Materials for Electronics", ed. Relva C. Buchanan, Marcel Dekker, Inc., Chapter 5 (1986). It is also known that chromium-doped vanadium sesquioxide, $(V,Cr)_2O_3$, exhibits a positive temperature coefficient characteristic. This material has a transition from low to high resistivity at around 80° C.

SUMMARY OF THE INVENTION

The resistor according to the invention includes a copper oxide ceramic with perovskite related structures such as $YBa_2Cu_3O_{7-x}$, $La_2CuO_4$ and related compounds with other rare earth elements substituted for Y and La. These ceramic materials exhibit a positive temperature coefficient of resistance effect in the temperature range of approximately 350°-900° C. The transition temperature region, that is, the region where the rate of change of resistance with temperature is greatest, may be adjusted by varying the composition of the ceramic material. The resistors of the present invention have an approximately 10,000-fold lower resistivity as compared to the known $BaTiO_3$ technology and can accommodate much higher current and power levels. These resistors will enable a positive temperature coefficient based self-regulated heater technology to be extended selectively to the technologically important temperature range above 400° C. Other applications include current stabilization, switching, temperature sensing, and temperature compensation of negative temperature coefficient devices. Both bulk and thick and thin film embodiments of the invention are disclosed.

Bulk resistors may be made by a variety of ceramic processing techniques. The film versions of the invention may be made by spin coating of a polymeric precursor, by sputtering, or by vapor deposition, to name a few.

DESCRIPTION OF THE PREFERRED EMBODIMENT

This invention is based on a recognition that copper oxide ceramics with perovskite related structures exhibit a strong positive temperature coefficient in the temperature range 400°-900° C. Included are materials such as $YBa_2Cu_3O_{7-x}$ and $La_2CuO_4$ and other related materials. Some of these materials have also exhibited high temperature (i.e. $>35°$ K.) superconducting properties.

Figure 1:
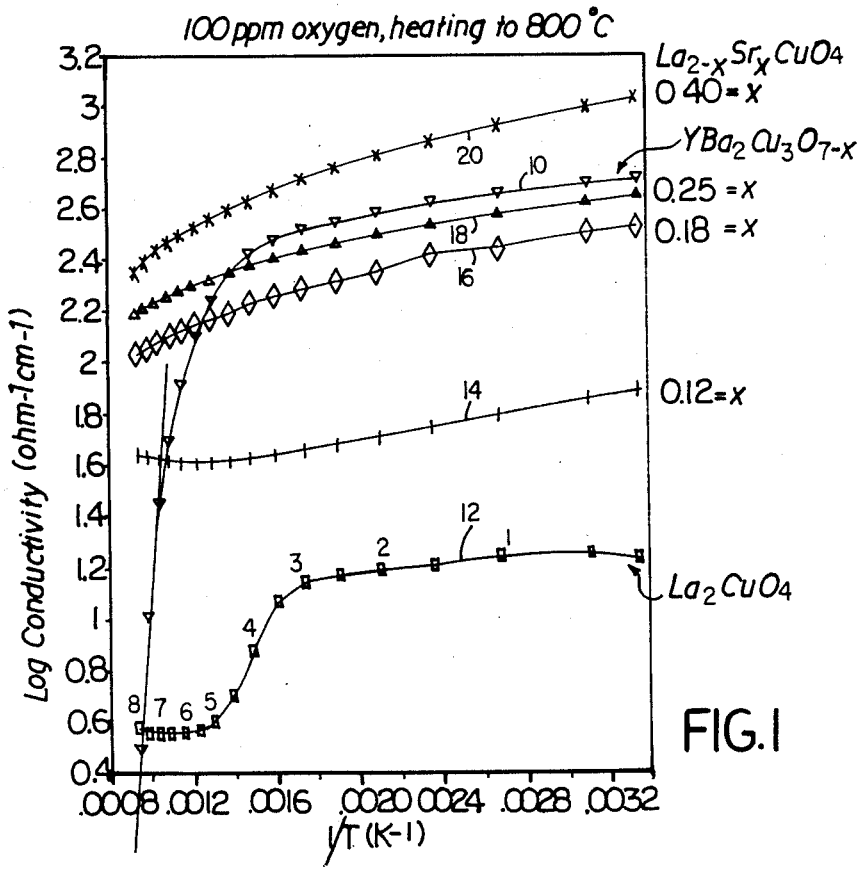
FIG. 1 is a graph of log conductivity as a function of reciprocal temperature.

FIG. 1 illustrates the positive temperature coefficient characteristics of the materials used for the resistor disclosed herein in an atmosphere having 100 ppm oxygen. A particularly preferred material is $YBa_2Cu_3O_{7-x}$ whose conductivity/temperature characteristic is shown by a curve 10. Note that this material has a transition temperature in the 500°-800° C. range. $La_2CuO_4$ represented by a curve 12 exhibits a transition temperature in the range 350°-500° C. Curves 14, 16, 18, and 20 represent $La_{2-x}Sr_xCuO_y$ as x varies from 0.12 to 0.40. Although the $La_{2-x}Sr_xCuO_y$ exhibits a positive temperature characteristic, it is much less pronounced than that for $YBa_2Cu_3O_{7-x}$ and $La_2CuO_4$.

Figure 2:
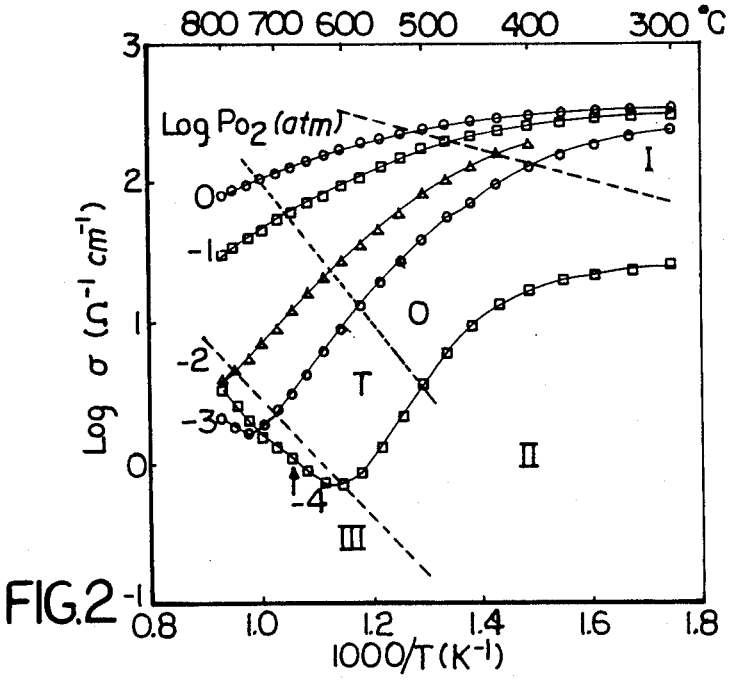
FIG. 2 is a graph of log conductivity versus reciprocal temperature for $YBa_2Cu_3O_{7-x}$ at differing oxygen partial pressures.

As shown in FIG. 2, the partial pressure of oxygen affects the positive temperature characteristics of the resistor. Note that a curve labelled 0 represents oxygen partial pressure at 1 atmosphere and curves labelled $-1$, $-2$, $-3$ and $-4$ represent oxygen partial pressures of $10^{-1}$, $10^{-2}$, $10^{-3}$ and $10^{-4}$, respectively. Thus, for $YBa_2Cu_3O_{7-x}$, in particular, increasing the partial pressure from 100 ppm to 1000 ppm tends to broaden the useful range over which the positive temperature coefficient effect occurs.

Figure 3:
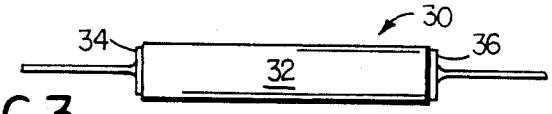
FIG. 3 is a cross-sectional view of a resistor disclosed herein.

With reference now to FIG. 3, a positive temperature coefficient resistor 30 includes, for example, a cylindrical body 32 made of one of the copper oxide ceramic materials discussed above. The ceramic material 32 is made porous to allow the ceramic to equilibrate readily with the atmosphere. Electrical contacts 34 and 36 are affixed to the ends of the ceramic material 32.

Figure 4:
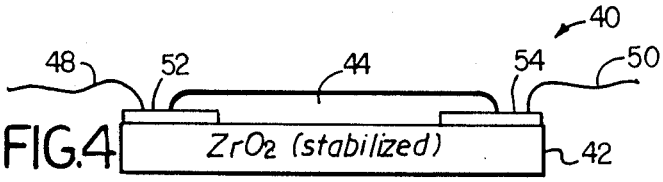
FIG. 4 is a cross-sectional view of a film version of the resistor of the invention.

A film version of the resistor disclosed herein is shown in FIG. 4. A resistor 40 has a substrate 42 made of a ceramic such as zirconium dioxide. A thin or thick film 44 of a copper oxide with perovskite related structure is deposited on the substrate 42, thereby bridging two metalizations 52 and 54 also disposed on the substrate 42. Electrical contacts 48 and 50 are affixed to the metallizations 52 and 54 at ends of the film 44 to complete the resistor 40.

The bulk ceramic material 32 of FIG. 3 may be made by any of the techniques known for making the recently discovered high temperature superconducting ceramic oxides. For example, see, *Fabrication of Ceramic Articles from High Tc Superconducting Oxides*, D. W. Johnson, et al., Adv.Ceram. Mat. 2, pp. 364-371 (1987); *High Tc Superconducting Films from Metallo-Organic Precursors*, W. W. Davison et al. in Mat. Res. Soc. Symp. Proc. on High-Temperature Superconductors, Vol. 99, Eds. M. B. Brodsky, R. C. Dynes, K. Kitizawa and H. L. Tuller, 1988, pp. 289-292; *A Metal Alloy Process for the Formation of Oxide Superconducting Films*, M. Garvitch and A. T. Fiory, ibid. pp. 297-301; and *Thin Films of Y—Ba—Ca—0 by R. F. Sputtering, P. H. Ballentine et al., ibid. pp.* 335-338, all of which are incorporated herein by reference.

One preferred method is the citrate technique in which, for example, precursors such as yttrium, barium, and copper, in such ratios as to obtain the desired cation fraction in the final product, are dissolved in a solution of citric acid and ethylene qlycol. The mixture is slowly heated to 100°-120° C. to form a polymer, which is subsequently pyrolized at 850° C. to remove the organic binder and form a fine black powder. This technique allows precise control over the composition of the resulting ceramic oxide. Powder processing techniques in which oxide powder constituents are sintered may also be used. See the Johnson et al. and the Davison et al. references cited above. For example, the powder may be isostatically pressed to 40 Kpsi, and then sintered at 930° C. in oxygen for 12 hours to form a ceramic.

The thin and thick film embodiments of FIG. 4 may be made by the citrate technique or by other film techniques such as sputtering and vapor deposition as described in the Garvitch et al. and the Ballantine et al. references cited above. To make either a thin film or a thick film by the citrate process, the liquid citrate solution is applied to a spinning substrate which spins the material to the desired thickness. After the film solidifies, it is pyrolyzed leaving the ceramic oxide.

Figure 5:
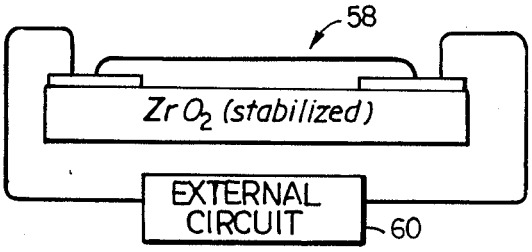
FIG. 5 is a block diagram of a circuit which employs the resistor disclosed herein.

The resistor embodying the invention may be used in a wide variety of applications where a device exhibiting a positive temperature coefficient of resistance above 300° C. is required. FIG. 5 illustrates in block diagram form a general circuit which employs such a resistor. As shown, a resistor 58 is connected to an external circuit 60. The specific internal design of the external circuit 60 depends, of course, upon the particular desired application. For example, the resistor 58 may be used as a self regulating heater or it may be used for temperature sensing, current stabilization, temperature compensation or as part of a switching circuit. Each of these applications implies a different design for the external circuit 60, the details of which are well known to those skilled in the art.

It is theorized that the positive temperature coefficient characteristics exhibited by the resistors disclosed herein are the result of a bulk transport mechanism in the material rather than being grain boundary-controlled as in the prior art barium titanate material.

Other closely related materials which fall within the scope of this invention are generated by either partially or totally substituting other rare earths or other alkaline earths for the yttrium and the barium, respectively. For example, neodymium, europium, dysprosium, or holmium, etc. may be substituted for yttrium and calcium or strontium may be substituted for barium. It has been demonstrated that such substitutions result in materials possessing substantially similar properties to those of $YBa_2Cu_3O_{7-x}$. See, for example,

*Substitution Effect of Sr for Ba of High $T_c$ Superconductivity* $YBa_2Cu_3O_{7-x}$ *Ceramics* by T. Wade et al., Jpn. J. Appl. Physics, Pt. 2, 26 [5]pp. L706-8 (1987).

*Superconducting and Structural Properties of the New* $Ba_{1-x}Ln_xCuO_{3-y}$ *Compound System* by S. Ohshima et al, ibid., pp. L815-817.

*Oxygen Stoichiometry in* $Ba_2YCu_3O_x$, $Ba_2GdCu_3O_x$ *and* $Ba_2EuCu_3O_x$ *Superconductors as a Function of Temperature* by G. S. Grader et al., Adv. Cer. Mat. 2 [3B], pp. 649-655 (1987).

*3d*—Metal Doping of the High Temperature Superconducting Perovskites La—Sr—Cu—O and Y—Ba—Cu—O by J. M. Tarascon et al., Phys. Rev. B36 [16] 8383 (1987).

*High $T_c$ Thin Films of* $(La_{1-x}M_x)$ $yCuO_{4-\delta}$*(M=Sr, Ba, Ca) Prepared by Sputtering* by S. Nagata et al., Jpn. J. Appl. Physic., pt. 2, 26 [4], pp. L410-12 (1987).

all of which are incorporated herein by reference. In addition, other transition metals may be partially substituted for copper. For example, see

*Superconductivity in* $YBa_2Cu_{3-y}Ni_yO_{7-\delta}$ by Y. Maeno et al., Jpn. J. Appl. Physics, Pt. 2, 26 [5], pp. L774-6.

also incorporated herein by reference.

It is recognized that modifications and variations of the present invention will occur to those skilled in the art and it is intended that all such modifications and variations be included within the scope of the appended claims.

What is claimed is:

1. A temperature sensitive circuit comprising:

a temperature sensitive element comprising a copper oxide ceramic with perovskite related structures; and electrical circuitry for exploiting the temperature coefficient of resistance characteristics of the temperature element within a preselected temperature range, the preselected temperature range being located above 300° C.

2. The temperature sensor of claim 1 wherein the copper oxide ceramic is $YBa_2Cu_3O_{7-x}$.

3. The temperature sensor of claim 1 wherein the ceramic is $La_2CuO_4$.

4. The temperature sensor of claim 1 wherein the ceramic is $La_{2-x}Sr_xCuO_y$.

5. The temperature sensor of claim 1 wherein the temperature coefficient of resistance of the ceramic oxide exhibits a transition region within the preselected temperature range and wherein the ceramic oxide is in the R—E—Cu—O system, where R is selected from the group of rare earths and E is selected from the group of alkaline earths.

6. The temperature sensor of claim 5 wherein R is ytrrium.

7. The temperature sensor of claim 5 wherein E is barium.

8. The temperature sensor of claim 6 wherein E is barium.

9. The temperature sensor of claim 5 wherein E is calcium.

10. The temperature sensor of claim 6 wherein E is calcium.

11. The temperature sensor of claim 5 wherein E is strontium.

12. The temperature sensor of claim 6 wherein E is strontium.

13. The temperature sensor of claim 6 wherein the copper ceramic oxide also includes an element selected from the group of transition metals, said element being partially substituted for the copper in the copper ceramic oxide.

14. The sensor of claim 13 wherein the element selected from the group of transition metals is nickel.

15. The sensor of claim 1 wherein the temperature sensitive element exhibits a positive temperature coefficient of resistance within the preselected temperature range.

16. The temperature sensitive circuit of claim 15 wherein said electrical circuitry exploits the positive temperature coefficient of resistance characteristics of the temperature sensitive element to monitor temperature.

17. The temperature sensitive circuit of claim 15 wherein the electrical circuitry exploits the positive temperature coefficient of resistance characteristics of the temperature sensitive element so that said element operates as a self regulating heater.

18. The temperature sensor of claim 17 wherein the copper oxide ceramic is $YBa_2Cu_3O_{7-x}$.

19. The temperature sensor of claim 17 wherein the ceramic is $La_2CuO_4$.

20. The temperature sensor of claim 17 wherein the ceramic is $La_{2-x}Sr_xCuO_y$.

21. The temperature sensor of claim 17 wherein the temperature coefficient of resistance of the ceramic oxide exhibits a transition region within the preselected temperature range and wherein the ceramic oxide is in the R—E—Cu—O system, where R is selected from the group of rare earths and E is selected from the group of alkaline earths.

22. The temperature sensor of claim 21 wherein R is yttrium.

23. The temperature sensor of claim 22 wherein E is barium.

24. The temperature sensor of claim 22 wherein E is barium.

25. The temperature sensor of claim 21 wherein E is calcium.

26. The temperature sensor of claim 22 wherein E is calcium.

27. The temperature sensor of claim 21 wherein E is strontium.

28. The temperature sensor of claim 22 wherein E is strontium.

29. The temperature sensor of claim 17 wherein the copper ceramic oxide also includes an element selected from the group of transition metals, said element being partially substituted for the copper in the copper ceramic oxide.

30. The sensor of claim 29 wherein the element selected from the group of transition metals is nickel.

* * * * *